US006773546B2

(12) United States Patent
Lightner

(10) Patent No.: US 6,773,546 B2
(45) Date of Patent: Aug. 10, 2004

(54) BLACK LIQUOR REMOVED FROM PULP

(76) Inventor: Gene E. Lightner, 706 SW. 296th, Federal Way, WA (US) 98023-3549

( * ) Notice: Subject to any disclaimer, the term of this patent is extended or adjusted under 35 U.S.C. 154(b) by 172 days.

(21) Appl. No.: 10/244,268

(22) Filed: Sep. 16, 2002

(65) Prior Publication Data

US 2004/0050509 A1 Mar. 18, 2004

(51) Int. Cl.[7] ..... D21C 9/02
(52) U.S. Cl. ..... 162/29; 162/60; 162/72; 162/74
(58) Field of Search ..... 162/29, 72, 60, 162/74

(56) References Cited

U.S. PATENT DOCUMENTS 4,956,048 A * 9/1990 Hise ..... 162/60

OTHER PUBLICATIONS

Handbook of Chemistry And Physics, 56$^{th}$ Edition, 1975–1976, R. C. Weast Editior, p. C–236, p. D–256.
Chlorinated Solvents, Product Stewardship Manual, Appendix B.

* cited by examiner

*Primary Examiner*—Peter Chin

(57) ABSTRACT

Pulp, containing black liquor, is separated to produce pulp substantially free of black liquor. An organic solvent forms a layer within a vessel and adding a pulp containing black liquor will establish three layers. From the lower layer, pulp substantially free of black liquor is removed. From the upper layer, black liquor substantially free of pulp is removed, and the layer of organic solvent is retained in place within the vessel. The resulting separation, by dissimilar densities of the organic solvent and pulp containing black liquor produces black liquor devoid of additional dilution by water whereby pulp containing black liquor is separated to create pulp substantially free of black liquor and provides black liquor separated from the organic solvent.

14 Claims, 3 Drawing Sheets

BLACK LIQUOR REMOVED FROM PULP

BACKGROUND OF THE INVENTION

Generally, pulp substantially devoid of black liquor is obtained by water washing of pulp containing black liquor. Various descriptions of water washing of pulp containing black liquor are found, for example, within U.S. Pat. Nos. 6,074,522, 6,159,338 and 5,753,074. A continuous diffuser for washing pulp is presented within U.S. Pat. No. 5,778, 704. These procedures produce pulp substantially devoid of black liquor and recovery of black liquor, diluted by water Therefore, an object of this invention is to obviate many of the limitations and disadvantages of the prior art.

This invention relates to production of pulp, substantially devoid of black liquor, and recovery of black liquor, undiluted by water.

An important object of this invention is to supply an organic solvent forming a layer within a vessel.

A significant object of this invention is wherein the organic solvent layer remains within the vessel.

A primary object of this invention is creation of pulp, substantially devoid of black liquor.

A secondary object of this invention wherein the organic solvent is a mixture of organic solvents which establish density.

A characteristic object of this invention is wherein the organic solvent performs separation of materials of dissimilar composition having individual densities.

An additional object of this invention is to perform this invention continuously at atmospheric pressure.

Another object of this invention is recovery of black liquor, undiluted by water.

Yet another object of this invention is to essentially separate pulp from black liquor.

With the above and other objects in view, this invention relates to the novel features and alternatives and combinations presently described in the brief description of the invention.

TERMS APPLIED IN THE INVENTION

Pulp, containing black liquor, obtained from digestion of wood chips, is composed fundamentally of cellulose. The pulp, must be removed from black liquor to create brown pulp substantially free of black liquor. Separation of pulp from black liquor is achieved by a difference in density of the main components. An organic solvent, of density greater than that of pulp and less than that of aqueous sodium compounds within black liquor is utilized for separation. Purposely the solvent is insoluble in both components. The organic solvent, as a layer, remains in place to separate pulp under the layer and separate black liquor over the layer. The organic solvent is customarily selected from the group consisting of halogen compounds and hydrocarbon compounds including an individual or combination thereof. Density of chlorinated solvents, reported within, "Product Stewardship Manual," supplied by Dow Chemical Company, appendix B, gives a specific gravity range of chlorinated solvents as 1.32 to 1.62, with a water solubility ranging in percent from 1.70 to 0.015. Black liquor, containing a trace of dissolved chlorinated solvents, may require water washing or distillation to recover and recycle the chlorinated solvents.

Cellulose density, reported within Handbook of Chemistry and Physics, 56th edition 1975–1976, page C-236 is about 1.3–1.6 grams/cc. Pulp consisting ordinarily of cellulose and hemicellulose has a similar density of about 1.3–1.6 grams/cc.

Black liquor, containing aqueous sodium compounds is of somewhat variable density, which is characterized by sodium hydroxide concentration, op cit., page D-256. Sodium hydroxide concentrations varying from 0.10% to 0.20% and densities ranging to 1.1109 to 1.2214 depend on sodium hydroxide concentration similar to that of black liquor.

Pulp, containing black liquor is thus separated from black liquor without filtration with water and subsequent dilution of black liquor. The net result is to obtain brown pulp substantially free of black liquor.

BRIEF DESCRIPTION OF THE INVENTION

The present invention, in its broadest aspect, is a method to produce pulp substantially free of black liquor is described, which comprises: providing a vessel, and an organic solvent for forming a layer of the organic solvent within the vessel and pulp containing black liquor. Upon adding pulp containing black liquor within the layer will form three layers, and removing pulp substantially free of black liquor from the lower layer, and removing black liquor substantially free of pulp from the upper layer, and retaining the organic solvent in place, whereby pulp containing black liquor is separated to create pulp substantially free of black liquor and provides black liquor from the organic solvent Key features of this invention are:

Organic solvent forms a layer within a vessel.

The organic solvent is restrained within a vessel.

The organic solvent is of a density greater than that of black liquor, and less than that of pulp.

The organic solvent is often a mixture of organic solvents to establish density.

The organic solvent performs separation of materials of dissimilar composition having individual densities.

Generating pulp, substantially free of black liquor, obtained from an organic solvent.

Creating black liquor, substantially free of pulp, obtained from an organic solvent.

Separating pulp containing black liquor.

Pulp, substantially free of black liquor containing dissolved organic solvent, may require distillation to recycle the organic solvent.

Pulp, substantially free of black liquor, containing dissolved organic solvent, is occasionally washed with water to remove traces of the organic solvent adhering to the pulp.

Black liquor, after separation, maintains its concentration and is undiluted by water washing.

The method is accomplished at atmospheric pressure.

The method is practiced in a continuous fashion.

The vessel utilized is often a settling tank.

Pulp substantially free of black liquor is subjected to bleaching.

Pulp substantially free of black liquor is subjected to a fourdrinier.

BRIEF DESCRIPTION OF THE DRAWINGS

The features that are considered characteristic of this invention are set forth in the appended claims. This invention, however, both as to its origination and method of operations as well as additional advantages will best be understood from the following description when read in conjunction with the accompanying drawings in which:

DETAILED DESCRIPTION OF THE PREFERRED EMBODIMENT

Figure 1:
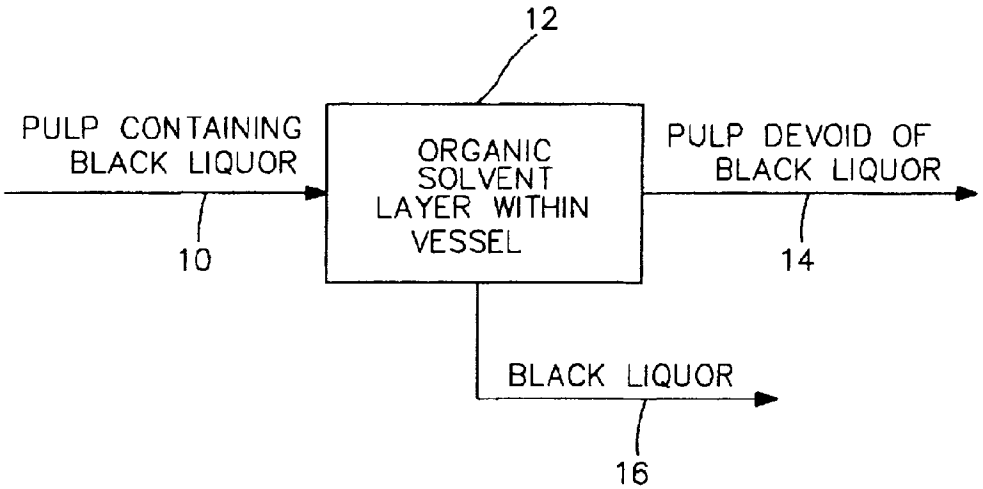
FIG. 1 is a flow sheet denoting the invention as set forth in the appended claims.

In the preferred embodiments of the present invention, pulp derived from wood digestion containing black liquor, is forwarded to a vessel containing an organic solvent used for separation by unlike densities. The flow diagram of FIG. 1 illustrates the general preferred embodiments of the present invention. In the diagram, rectangles represent stages or functions of the present invention and not necessarily separate components. Arrows indicate direction of flow in the method.

Referring to FIG. 1, pulp containing black liquor 10 is conveyed to organic solvent layer within vessel 12 to separate pulp devoid of black liquor 14 and black liquor 16 for further treatment. Pulp containing black liquor 10 is separated from components by an organic solvent, insoluble in black liquor and pulp. The organic solvent and components separated have dissimilar densities to produce black liquor 16 and pulp devoid of black liquor 14. The organic solvent layer remains in the vessel for continued separation. The described black liquor, substantially free of pulp, maintains its concentration.

Figure 2:
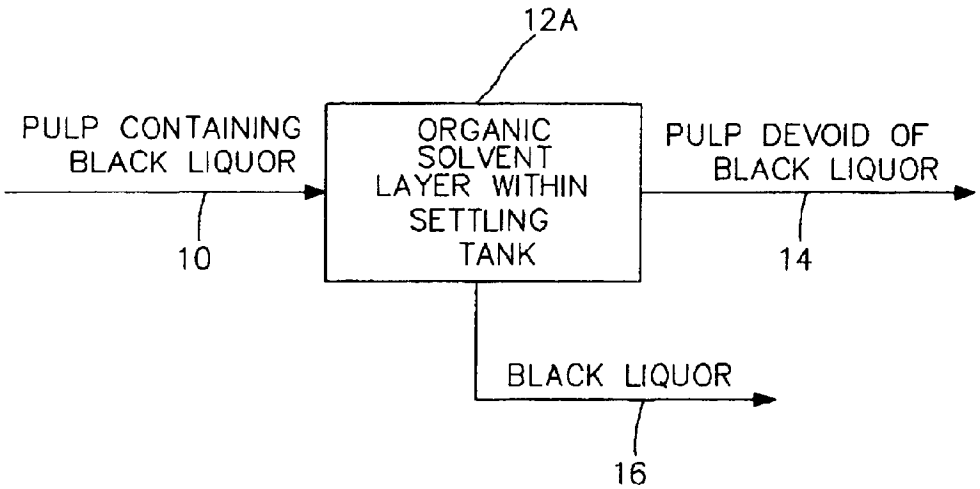
FIG. 2 is a flow sheet denoting a comparable method to that of FIG. 1.

Referring to FIG. 2, pulp containing black liquor 10 is conveyed to organic solvent layer within settling tank 12A to separate pulp devoid of black liquor 14 and black liquor 16 for further treatment. Pulp containing black liquor 10 is separated from components by an organic solvent, insoluble in black liquor and pulp. The organic solvent and components, thus separated have dissimilar densities to separate the components by settling to produce black liquor 16 and pulp devoid of black liquor 14. The organic solvent layer remains in the settling tank for continued separation. Introduction of settling tank 12A is the only distinction of FIG. 2, compared to FIG. 1.

Figure 3:
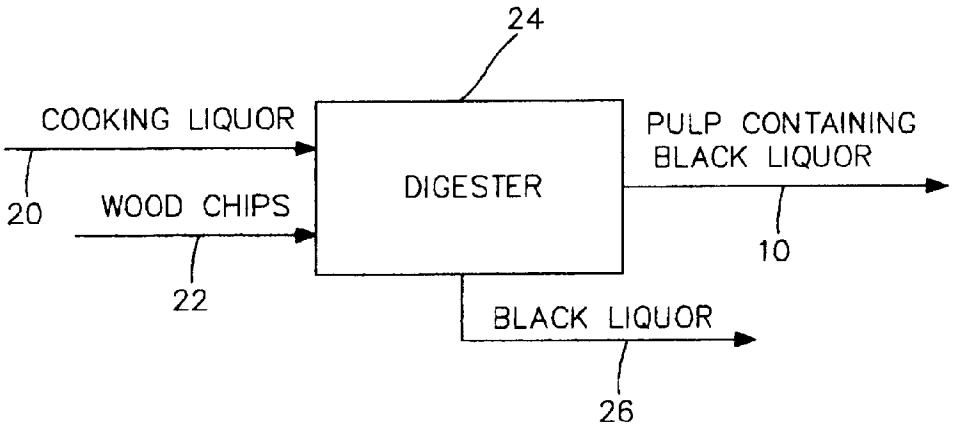
FIG. 3 is a flow sheet denoting a digester to produce pulp containing black liquor.

Referring to FIG. 3, cooking liquor 20 and wood chips 22 are conveyed to digester 24 to digest wood and create pulp containing black liquor 10 and black liquor 26 for separation by organic solvent layer within vessel 12 or organic solvent layer within settling tank 12A.

Figure 4:
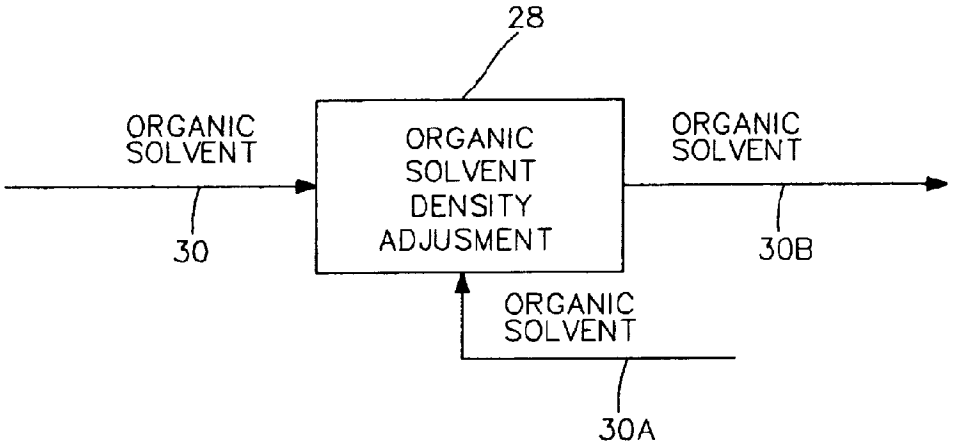
FIG. 4 is a flow sheet denoting organic solvent density adjustment.

Referring to FIG. 4, organic solvent 30 is conveyed to organic solvent density adjustment 28 for density adjustment by addition of organic solvent 30A to generate organic solvent 30B with density adjusted 30B. Thus the organic solvent is a mixture of organic solvents to establish density. This procedure is ordinarily performed only once.

Figure 5:
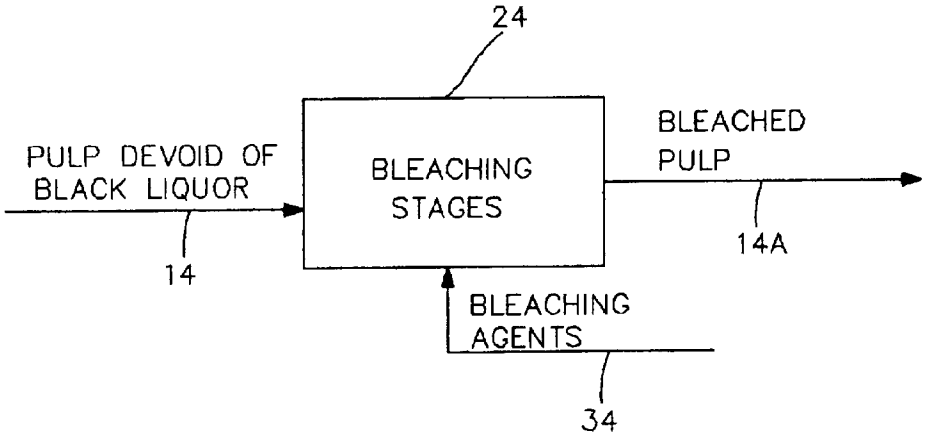
FIG. 5 is a flow sheet denoting bleaching of pulp.

Referring to FIG. 5, pulp devoid of black liquor 14 is conveyed to bleaching stages 24 to create bleached pulp 14A from bleaching agents 34. Thus pulp substantially free of black liquor, has been subjected to bleaching.

Figure 6:
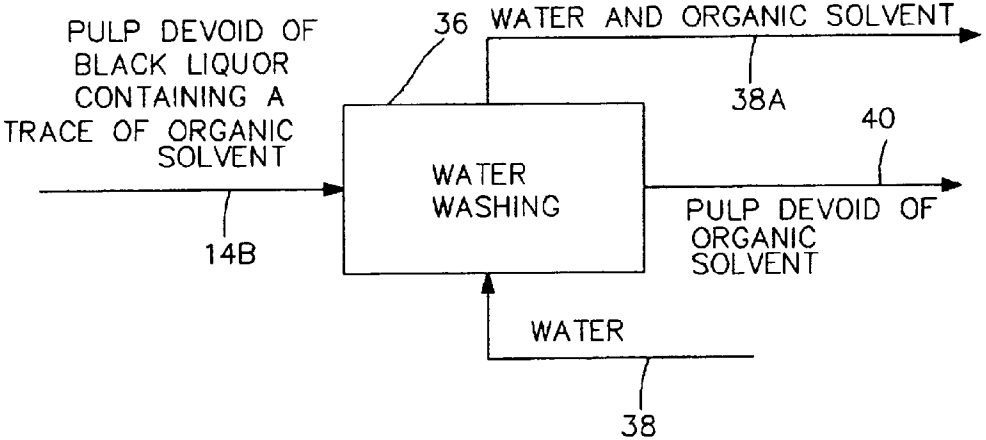
FIG. 6 is a flow sheet denoting water washing of pulp containing a trace of organic solvent.

Referring to FIG. 6, pulp devoid of black liquor, containing a trace of organic solvent, 14B is conveyed to a stage for water washing 36 by water 38 to establish water and organic solvent 38A and pulp devoid of organic solvent 40. Thus pulp was been washed with water to remove traces of the organic solvent adhering to the pulp. Water and organic solvent 38A, thus established, form insoluble organic solvent 14B. Both water and organic solvent 14B are separated and recycled.

What is claimed is:

1. A method to produce pulp substantially free of black liquor, which comprises:

providing a vessel, and providing an organic solvent, and forming a layer of said organic solvent within said vessel, and providing pulp containing black liquor, and adding said pulp containing black liquor within said layer to form three layers, and removing said pulp substantially free of black liquor from the lower layer, and removing black liquor substantially free of pulp from the upper layer, and retaining said layer of said organic solvent in place within said vessel whereby pulp containing black liquor is separated to create pulp substantially free of black liquor and provides black liquor from the organic solvent.

2. The method described within claim 1 wherein said pulp containing black liquor is derived from wood digestion.

3. The method described within claim 1 wherein said organic solvent is a mixture of organic solvents to establish density of said organic solvent.

4. The method described within claim 1 wherein said organic solvent performs separation of materials of dissimilar composition having individual densities.

5. The method described within claim 1 wherein said pulp substantially free of black liquor is obtained from said layer of organic solvent located within a settling tank.

6. The method described within claim 1 wherein said black liquor substantially free of pulp is obtained from said layer of organic solvent located within a vessel.

7. The method described within claim 1 wherein said pulp substantially free of black liquor is washed with water to remove traces of the organic solvent adhering to the pulp.

8. The method described within claim 1 wherein said pulp substantially free of black liquor is subjected to bleaching.

9. The method described within claim 1 wherein said pulp substantially free of black liquor is subjected to a fourdrinier.

10. The method described within claim 1 wherein said black liquor, substantially free of pulp, maintains its concentration.

11. The method described within claim 1 wherein said method is accomplished at atmospheric pressure.

12. The method described within claim 1 wherein said method is method is practiced in a continuous fashion.

13. The method described within claim 1 wherein said organic solvent remains within said vessel.

14. The method described within claim 1 wherein said organic solvent is selected from the group consisting of halogen compounds and hydrocarbon compounds or combination thereof.

* * * * *